US006064159A

United States Patent [19]

Yamada et al.

[11] Patent Number: 6,064,159

[45] Date of Patent: May 16, 2000

[54] POWER-SAVING STROBOSCOPIC DEVICE

[75] Inventors: Hiroshi Yamada; Akira Inoue, both of Hachioji, Japan

[73] Assignee: Olympus Optical Co., Ltd., Tokyo, Japan

[21] Appl. No.: 08/739,434

[22] Filed: Oct. 29, 1996

[30] Foreign Application Priority Data

Nov. 2, 1995 [JP] Japan ..... 7-286091

[51] Int. Cl.[7] ..... H05B 37/02

[52] U.S. Cl. ..... 315/241 R; 315/241 P; 315/241 S

[58] Field of Search ..... 315/241 S, 241 P, 315/241 R; 396/205, 206

[56] References Cited

U.S. PATENT DOCUMENTS 3,716,753 2/1973 Exner ..... 315/241 P
5,661,372 8/1997 Ishimaru et al. ..... 315/241 P

FOREIGN PATENT DOCUMENTS 58-186198 10/1983 Japan .
60-241775 11/1985 Japan .

*Primary Examiner*—David H. Vu
*Attorney, Agent, or Firm*—Frishauf, Holtz, Goodman, Langer & Chick, P.C.

[57] ABSTRACT

In a power-saving stroboscopic device, a main capacitor is not completely discharged even in full light emission, so that a predetermined amount of charge can be left in a main capacitor, in order to save power in a stroboscopic circuit of the device. A light emission unit of the stroboscopic device can perform full light emission and flat emission based on a period of light emission time set by predetermined conditions. The stroboscopic device comprises a light emission control unit and a control unit for controlling a period of light emission time, so that a residual voltage in a main capacitor in the stroboscopic circuit is higher than a residual voltage after full light emission, in order to improve the charging efficiency after the full light emission.

21 Claims, 8 Drawing Sheets

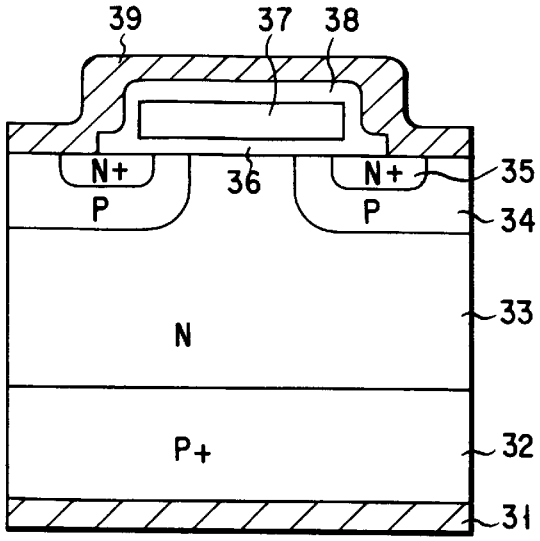
FIG. 3
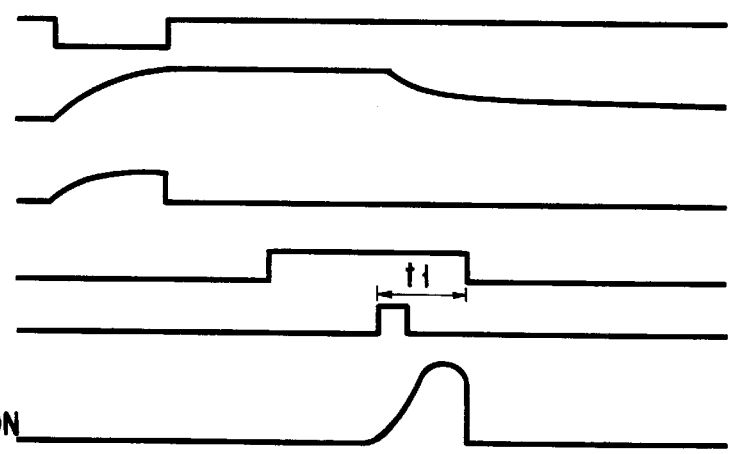
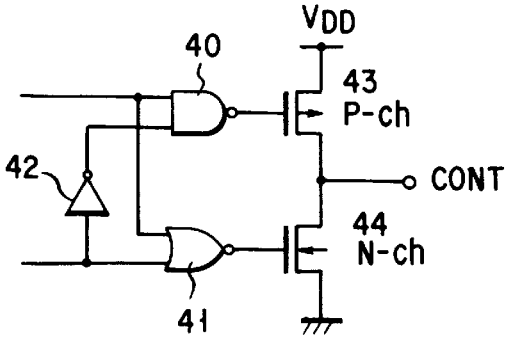
FIG. 5

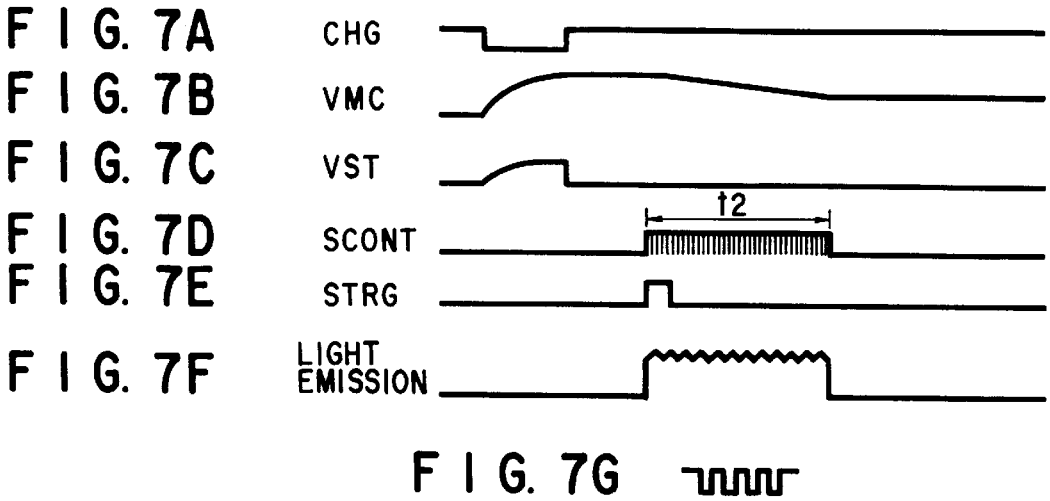
FIG. 7A
CHG
FIG. 7B
VMC
FIG. 7C
VST
t2
FIG. 7D
SCONT
FIG. 7E
STRG
FIG. 7F
LIGHT EMISSION
FIG. 7G
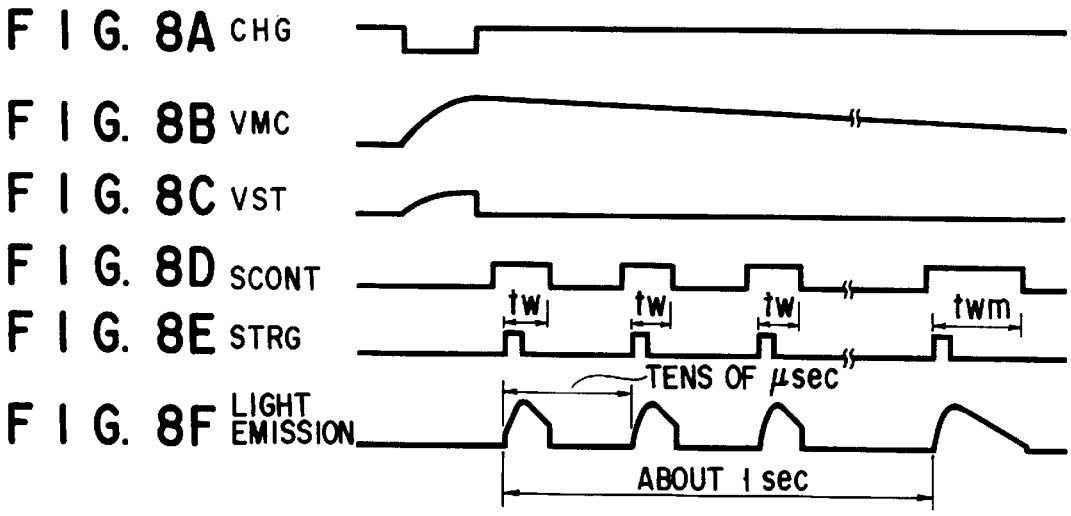
FIG. 8A CHG
FIG. 8B VMC
FIG. 8C VST
FIG. 8D SCONT
tw
tw
tw
twm
FIG. 8E STRG
TENS OF μsec
FIG. 8F LIGHT EMISSION
ABOUT 1 sec

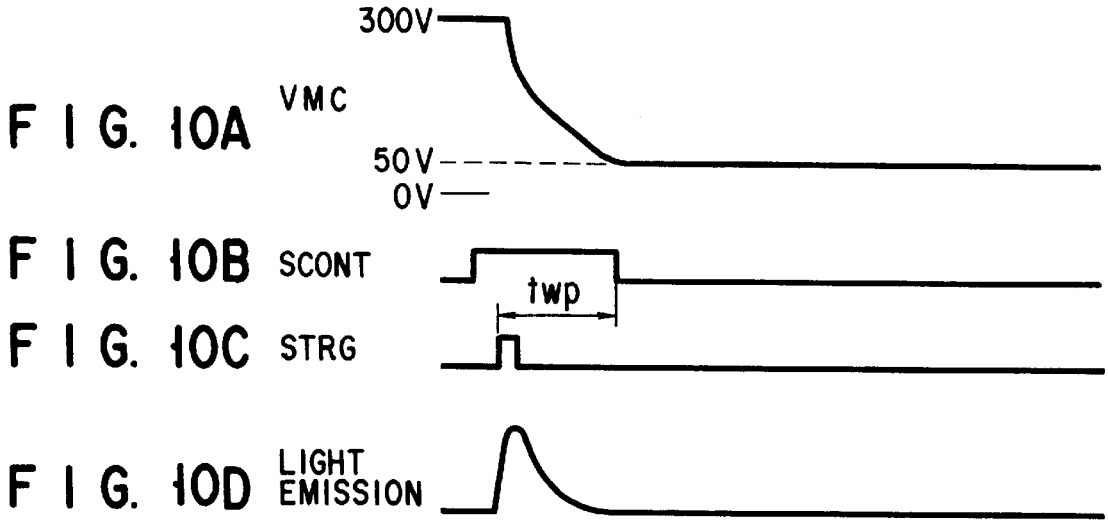
FIG. 10A
VMC
300V
50V
0V
FIG. 10B
SCONT
twp
FIG. 10C
STRG
FIG. 10D
LIGHT EMISSION
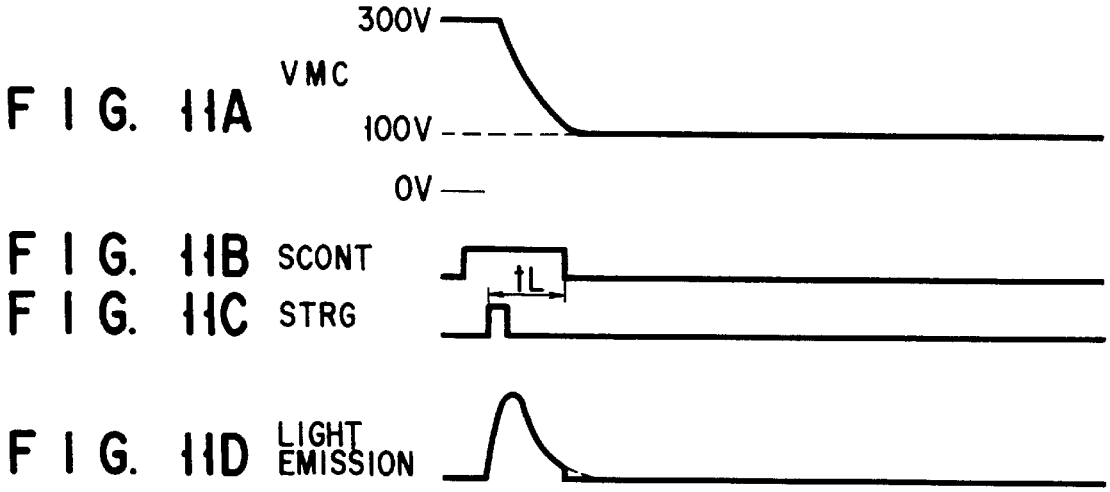
FIG. 11A
VMC
300V
100V
0V
FIG. 11B
SCONT
tL
FIG. 11C
STRG
FIG. 11D
LIGHT EMISSION

POWER-SAVING STROBOSCOPIC DEVICE

BACKGROUND OF THE INVENTION

1. Field of the Invention

The present invention relates to a stroboscopic device which emits flash light to illuminate an object in an image-pickup operation, used in, for example, an image-pickup device, such as a camera.

2. Description of the Related Art

A stroboscopic device for illuminating an object has been used in order to pick up a satisfactory image in a dark place.

For example, Jpn. Pat. Appln. KOKOKU Publication No. 5-40551 discloses a technique for successively changing the ratio of the numbers of turns of coils in a booster transformer, thereby realizing power-saving stroboscopic light emission.

Jpn. Pat. Appln. KOKAI Publication No. 58-186198 discloses a technique for successively switching a plurality of main capacitors, so that a charging current can be uniform, thereby improving the charging efficiency.

The technique disclosed in Jpn. Pat. Appln. KOKOKU Publication No. 5-40551 is disadvantageous in that the structure of the transformer is complicated and a switch control circuit is required to change the ratio of the numbers of turns of coils.

The technique disclosed in Jpn. Pat. Appln. KOKAI Publication No. 58-186198 is disadvantageous in that a plurality of main capacitors and a switch control circuit for switching the main capacitors are required.

Since the aforementioned switch control circuits use a large current and a high voltage, a large amount of space and cost are required for the circuits.

SUMMARY OF THE INVENTION

The present invention has been made to overcome the above disadvantages of the conventional art. It is accordingly an object of the present invention to provide a power-saving stroboscopic device, in which the main capacitor is not completely discharged even in full light emission, so that a predetermined amount of charge can be left.

To achieve the above object, according to an aspect of the present invention, there is provided a stroboscopic device for illuminating an object, comprising: a discharge tube for emitting light to illuminate the object; a capacitor for storing energy to cause the discharge tube to emit light; charging means for charging the capacitor to a predetermined voltage; and light emission control means for discharging the energy from the capacitor through the discharge tube, thereby causing the discharge tube to emit light, and for controlling light emission so that the capacitor has a predetermined amount of residual energy after discharge.

According to another aspect of the present invention, there is provided a stroboscopic device for illuminating an object, comprising: a discharge tube for emitting light to illuminate the object; a capacitor for storing energy to cause the discharge tube to emit light; charging means for charging the capacitor; residual energy lower limit setting means for setting a lower limit of residual energy in the capacitor after the discharge tube has emitted light; determining means for determining whether the lower limit of residual energy in the capacitor should be set; and light emission control means for, if the determining means determine that the lower limit of residual energy should be set, discharging the energy from the capacitor through the discharge tube, thereby causing the discharge tube to emit light, and for controlling light emission so that the capacitor has residual energy greater than the lower limit after discharge.

According to still another aspect of the present invention, there is provided a stroboscopic device for illuminating an object, comprising: a discharge tube for emitting light to illuminate the object; a capacitor for storing energy to cause the discharge tube to emit light; a charging circuit for charging the capacitor; a light emitting circuit for causing the discharge tube to emit light by discharging the energy from the capacitor through the discharge tube; selecting means for selecting one of a normal light emission mode and an energy-saving light emission mode in which a maximum amount of emitted light is less than that in full light emission in the normal light emission mode; and a light emission control circuit for controlling light emission in the mode selected by the selecting means.

According to a further aspect of the present invention, there is provided a stroboscopic device for illuminating an object, comprising: a discharge tube for emitting light to illuminate the object; a capacitor for storing energy to cause the discharge tube to emit light; a charging circuit for charging the capacitor; a light emitting circuit for causing the discharge tube to emit light by discharging the energy from the capacitor through the discharge tube; time counting means for counting time from a start of light emission; light emission continuation time setting means for setting a period of light emission time in which the light emission continues from the start to an end of light emission; and a control circuit for causing the discharge tube to emit light by discharging the energy from the capacitor through the discharge tube and for controlling light emission so that a period of light emission time may not exceed the period of light emission time set by the light emission continuation time setting means.

According to a still further aspect of the present invention, there is provided a stroboscopic device for illuminating an object, comprising: a discharge tube for emitting light to illuminate the object; a capacitor for storing energy to cause the discharge tube to emit light; a charging circuit for charging the capacitor; a light emitting circuit for causing the discharge tube to emit light by discharging the energy of the capacitor through the discharge tube; time counting means for counting time from a start of light emission; light emission continuation time setting means for setting a period of light emission time in which the light emission continues from the start to an end of light emission; determining means for determining whether the period of light emission time should be set; and control means for, if the determining means determine that the period of light emission time should be set, controlling light emission so that a period of light emission time may not exceed the set period of light emission time.

According to still another aspect of the present invention, there is provided a stroboscopic device for illuminating an object, comprising: a discharge tube for emitting light to illuminate the object; a capacitor for storing energy to cause the discharge tube to emit light; a charging circuit for charging the capacitor; voltage detecting means for detecting a voltage of the capacitor; a light emitting circuit for causing the discharge tube to emit light by discharging the energy of the capacitor through the discharge tube; and a light emission stopping circuit for stopping light emission when the voltage of the capacitor detected by the voltage detecting means is a predetermined value.

According to still another aspect of the present invention, there is provided a stroboscopic device comprising: a light emission discharge tube which emits light by discharging a main capacitor; light emission time setting means for setting a period of light emission time, so that a residual voltage in the main capacitor after light emission is higher than a residual voltage after normal full light emission; and light emission control means for controlling light emission of the light emission discharge tube in accordance with the set period of light emission time.

According to still another aspect of the present invention, there is provided a stroboscopic device comprising: a light emission discharge tube which emits light by discharging a main capacitor; light emission time setting means for setting a period of light emission time, so that a residual voltage in the main capacitor after light emission is higher than a residual voltage after normal full light emission; light emission time changing means for changing the set period of light emission time in accordance with a voltage of the main capacitor before light emission; and light emission control means for controlling light emission of the light emission discharge tube in accordance with the changed period of light emission time.

According to still another aspect of the present invention, there is provided a stroboscopic device comprising: a light emission discharge tube which emits light by discharging a main capacitor; selecting means for selecting one of a normal light emission mode for performing full light emission and an energy-saving light emission mode in which consumed light emission energy is suppressed less than that in the full light emission; and light emission control means for setting a period of light emission time so that when the energy-saving light emission mode is selected, a residual voltage in the main capacitor after light emission is higher than a residual voltage after full light emission, and controlling light emission of the light emission discharge tube in accordance with the set period of light emission time.

According to still another aspect of the present invention, there is provided a stroboscopic device comprising: a light emission discharge tube which emits light by discharging a main capacitor; selecting means for selecting one of a first period of light emission time calculated in accordance with a scene to be photographed and a second period of light emission time in which a residual voltage in the main capacitor after light emission is higher than a residual voltage after full light emission, the selecting means selecting the second period of light emission time if the second period of light emission time is shorter than the first period of light emission time, and if not, selecting the first period of light emission time; and light emission control means for controlling light emission of the light emission discharge tube in accordance with the selected period of light emission time.

According to still another aspect of the present invention, there is provided a stroboscopic device which can perform full light emission, comprising voltage control means for controlling a residual voltage in a main capacitor, so that the residual voltage in the main capacitor after light emission is higher than a residual voltage after full light emission, in order to improve a charge efficiency of the main capacitor after the full light emission.

According to still another aspect of the present invention, there is provided a stroboscopic device which can perform full light emission, comprising: calculating means for calculating a period of light emission time set by predetermined photographic conditions; comparing means for comparing a first period of light emission time with a second period of light emission time in which a residual voltage in the main capacitor after light emission is higher than a residual voltage after full light emission; and stroboscopic control means for controlling the first and second periods of light emission time based on the set period of light emission time.

According to still another aspect of the present invention, there is provided a stroboscopic device which can perform full light emission, comprising: selecting means for selecting one of a normal light emission mode in which full light emission is performed and an energy-saving light emission mode in which light emission is ceased slightly earlier than in the case of the full light emission; and light emission control means for controlling a period of light emission time, so that the residual voltage in the main capacitor after light emission is higher than a residual voltage after full light emission, when the energy-saving light emission mode is selected.

According to still another aspect of the present invention, there is provided a stroboscopic device which can perform full light emission, comprising: selecting means for selecting one of a normal light emission mode in which full light emission is performed and an energy-saving light emission mode in which light emission is ceased slightly earlier than in the case of the full light emission; determining means for determining whether a period of light emission time set in accordance with a distance to an object is within a limited period of light emission time which is predetermined for the energy-saving light emission mode, when the energy-saving light emission mode is selected; and light emission control means for controlling a period of light emission time, so that a residual voltage in the main capacitor after light emission is higher than a residual voltage after full light emission, when the set period of light emission time is not within the limited period of light emission time.

According to still another aspect of the present invention, there is provided a stroboscopic device which can perform full light emission, comprising: calculating means for calculating a period of light emission time set by predetermined photographic conditions; selecting means for selecting one of a normal light emission mode in which full light emission is performed and an energy-saving light emission mode in which light emission is ceased slightly earlier than in the case of the full light emission;

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 3 is a cross-sectional view of a general IGBT (Insulated Gate Bipolar Transistor);

FIGS. 4A to 4F are timing charts showing an operation of the stroboscopic device of the embodiment shown in FIG. 2, wherein FIG. 4A is a waveform diagram of a signal CHG; FIG. 4B is a waveform diagram of a signal VMC; FIG. 4C is a waveform diagram of a signal VST; FIG. 4D is a waveform diagram of a signal SCOUT; FIG. 4E is a waveform diagram of a signal STRG; and FIG. 4F is a waveform diagram of light emission;

FIG. 5 is a circuit diagram of an output portion of a CONT terminal within a CPU 21;

FIGS. 7A to 7G are timing charts showing an operation of the stroboscopic device of the embodiment shown in FIG. 6, wherein FIG. 7A is a waveform diagram of a signal CHG; FIG. 7B is a waveform diagram of a signal VMC; FIG. 7C is a waveform diagram of a signal VST; FIG. 7D is a waveform diagram of a signal SCOUT; FIG. 7E is a waveform diagram of a signal STRG; FIG. 7F is a waveform diagram of light emission; and FIG. 7G is an enlarged view of a portion t2 of the signal SCONT shown in FIG. 7D;

FIGS. 8A to 8F are timing charts showing another operation of the stroboscopic device of the embodiment shown in FIG. 2 or FIG. 6, wherein FIG. 8A is a waveform diagram of a signal CHG; FIG. 8B is a waveform diagram of a signal VMC; FIG. 8C is a waveform diagram of a signal VST; FIG. 8D is a waveform diagram of a signal SCOUT; FIG. 8E is a waveform diagram of a signal STRG; and FIG. 8F is a waveform diagram of light emission;

FIGS. 10A to 10D are timing charts in a case of a normal light emitting operation, wherein FIG. 10A is a waveform diagram of a signal VMC; FIG. 10B is a waveform diagram of a signal SCOUT; FIG. 10C is a waveform diagram of a signal STRG; and FIG. 10D is a waveform diagram of light emission;

FIGS. 11A to 11D are timing charts in a case of a power-saving light emitting operation, wherein FIG. 11A is a waveform diagram of a signal VMC;

FIG. 11B is a waveform diagram of a signal SCOUT;

FIG. 11C is a waveform diagram of a signal STRG; and

FIG. 11D is a waveform diagram of light emission; and

DETAILED DESCRIPTION OF THE PREFERRED EMBODIMENTS

Embodiments of the present invention will be described with reference to the accompanying drawings.

Figure 1:
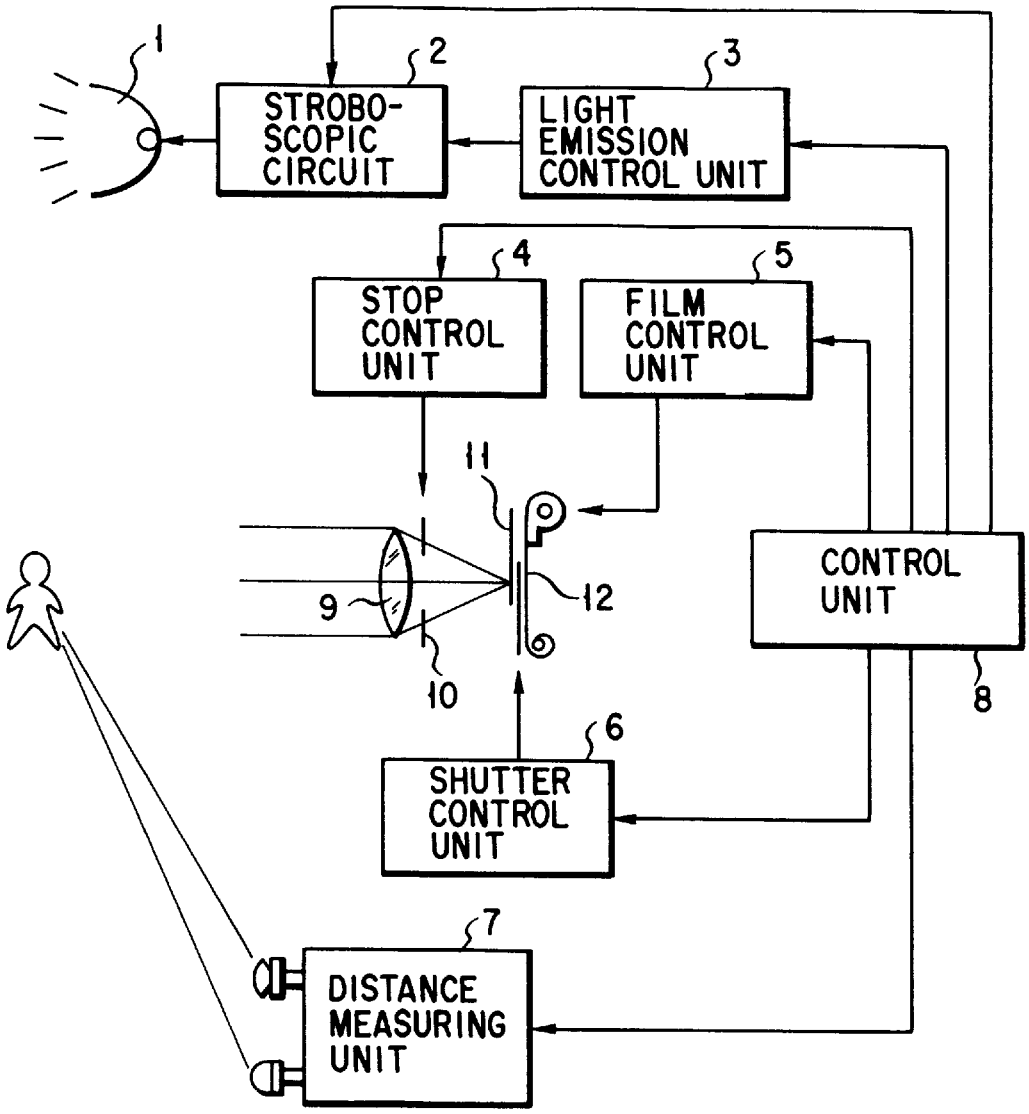
FIG. 1 is a schematic diagram of a camera to which a stroboscopic device of the present invention is applied.

FIG. 1 is a schematic diagram of a camera to which a stroboscopic device of the present invention is applied.

As shown in FIG. 1, an output of a control unit 8 is connected to an input of a light emitting unit 1 through a light emission control unit 3 and a stroboscopic circuit 2. Further, it is connected to a film 12 through a film control unit 5, to a stop 10 through a stop control unit 4, to a shutter 11 through a shutter control unit 6, and to a distance measuring unit 7.

With the above structure, the stroboscopic circuit 2 is controlled by the light emission control unit 3 under control of the control unit 8, and light emission of the light emitting unit 1 is controlled by the stroboscopic circuit 2. Further, under control of the control unit 8, feed of the film 12 is controlled by the film control unit 5, the stop 10 is controlled by the stop control unit 4 and opening or closing of the shutter 11 is controlled by the shutter control unit 6. The distance measuring unit 7 measures a distance to an object.

Figure 2:
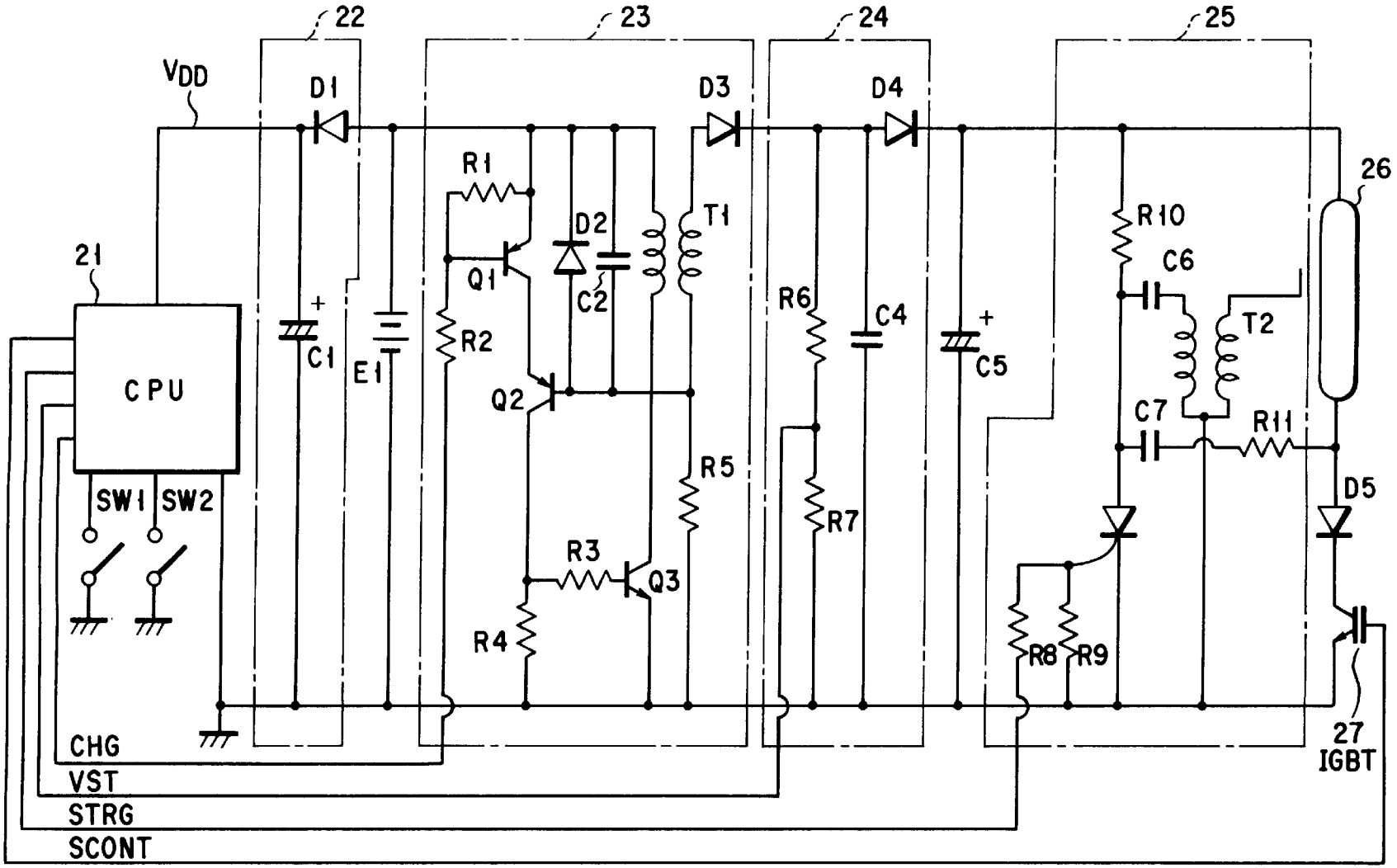
FIG. 2 is a diagram showing a stroboscopic device according to an embodiment of the present invention.

FIG. 2 shows the structure of a stroboscopic device according to an embodiment of the present invention.

As shown in FIG. 2, a power battery E1 and a main capacitor C5 are connected parallel to a CPU 21. In addition, a power filter circuit 22, a booster power circuit 23 in the stroboscopic circuit, a voltage detecting circuit 24 for detecting a charge voltage of the main capacitor C5, a trigger circuit 25, and a serial circuit (including a flash discharge tube (Xe tube) 26, a diode D5 and an IGBT (Insulated Gate Bipolar Transistor) 27 serving as a gate control type switching element) are connected parallel to the CPU 21.

The power filter circuit 22 comprises a capacitor C1 connected parallel to the power battery E1, and a diode D1 connected between the positive side of the capacitor C1 and the positive side of the power battery E1.

The booster power circuit 23 in the stroboscopic device comprises a serial circuit including resistors R1 and R2; transistors Q1 and Q2 and a resistor R4 which are connected parallel to the power battery E1, a diode D2, a capacitor C2 and a transformer T1 which are connected parallel to one another; a transistor Q3 connected to a primary side of the transformer T1; a resistor R3 connected between the transistor Q3 and a resistor R4; and a resistor R5 and a diode D3 connected to a secondary side of the transformer T1. These elements are connected as shown in FIG. 2.

The voltage detecting circuit 24 comprises a serial circuit including resistors R6 and R7; a capacitor C4 connected parallel to the serial circuit; and a diode D4 connected between the capacitor C4 and the main capacitor C5. The trigger circuit 25 comprises registers R8, R9 and R10, a thyristor SCR1, capacitors C6 and C7, a resistor R11, and a trigger transformer T2, which are interconnected as shown in FIG. 2. The trigger transformer T2 applies a trigger to the flash discharge tube 26.

The IGBT 27 is connected serially to the flash discharge tube 26 and the diode D5. It controls an amount of light by switching a light emitting current flowing through the flash discharge tube 26 and operates in accordance with the state of a signal SCONT supplied from the CPU 21. A power switch SW1 and a release switch SW2 are connected to the CPU 21.

The CPU 21 supplies, as well as the aforementioned signal SCONT supplied to the IGET 27, a signal CHG to the booster power circuit 23, a signal VST to the voltage detecting circuit 24, and a signal STRG to the trigger circuit 25. Further, the CPU 21 controls the stroboscopic circuit. A power VDD is supplied to the CPU 21 from the power battery E1 through the power filter circuit 22.

The IGBT 27 will now be described, prior to describing operations of the circuits of the stroboscopic device.

FIG. 3 is a cross-sectional view of a general IGBT.

As shown in FIG. 3, a P layer 32 and an N layer 33 are formed in this order on the upper surface of a collector electrode 31. In a surface region of the N layer 33, a P layer 34 of a lower impurity concentration as compared to the P layer 32, and an N layer 35 of a higher impurity concentration as compared to the N layer 33 are formed. A surface region of the P layer 34, interposed between the N layers 33 and 35, serves as a channel region. A gate electrode 37 is formed above the channel region with a gate oxide film 36 interposed therebetween. An emitter electrode 39 is formed above the gate electrode 37 with an insulating film 38 interposed therebetween.

In the IGBT 27 thus constructed, when a gate voltage positive to the emitter is applied to the gate electrode 37, the aforementioned channel is formed and a current flows between the collector and the emitter. In general, the gate voltage must be about 10V to 40V. However, if a thin film is used as the gate oxide film 36 or a refined design rule is employed, it is possible to manufacture an IGBT 27 in which a satisfactory collector-emitter current can be caused to flow even with a gate voltage of 4V. Such a low-voltage gate drive IGBT is applied to the stroboscopic device according to the embodiment of the present invention.

A basic operation of the stroboscopic device will now be described with reference to the timing charts shown in FIGS. 4A to 4F. When the signal CHG is low in level (see FIG. 4A), the booster power circuit 23 in the stroboscopic circuit is operated and a boosted voltage is charged in the main capacitor C5 (see FIG. 4B). The charged voltage is monitored by the voltage detecting circuit 24. When the monitored voltage reaches a predetermined value (see FIG. 4C), the signal CHG is caused to be high in level and the boosting operation is ceased.

In a light emitting operation, prior to a light emission start signal, the signal SCONT is caused to be high in level to keep the IGBT on (see FIG. 4D). Thereafter, the signal STRG is caused to be high in level in response to a light emission start signal (see FIG. 4E), so that the thyristor SCRI is turned on and the flash discharge tube 26 is excited by the trigger circuit 25 and starts emitting (see FIG. 4F). When the signal SCONT is caused to be low in level while light is being emitted, the IGBT 27 is turned off and the light emission is ceased.

FIG. 5 is a circuit diagram of an output portion of a CONT terminal within the CPU 21. The output portion comprises a NAND circuit 40, a NOR circuit 41, an inverter 42, a P channel (P-ch) transistor 43 and an N channel (N-ch) transistor 44, which are interconnected as shown in FIG. 5. When the transistor 43 is on and the transistor 44 is off, the voltage VDD is output through the terminal CONT.

When the transistor 43 is off and the transistor 44 is on, a voltage of the ground level is output. If the power battery E1 is a 6V battery, the voltage VDD is about 5.5V, i.e., lowered by VF of the diode D1. At this time, the voltage of high level output through the terminal CONT is about 5.3V due to the voltage drop in the transistor 43. Since the IGBT 27 is the aforementioned low voltage drive IGBT, it can be turned on satisfactorily even by the voltage of 5.3V.

The timing of turning on the IGBT 27 prior to the light emission start signal, i.e., the timing when the signal SCONT becomes high, can be any time before the signal STRG is input, for example, when the camera is powered on. Further, the timing can be when it is judged that stroboscopic light is required at low luminance time, or when the release is depressed. In the case of an SLR (Single-lens reflex), it can be mirror up time, or the like.

Figure 6:
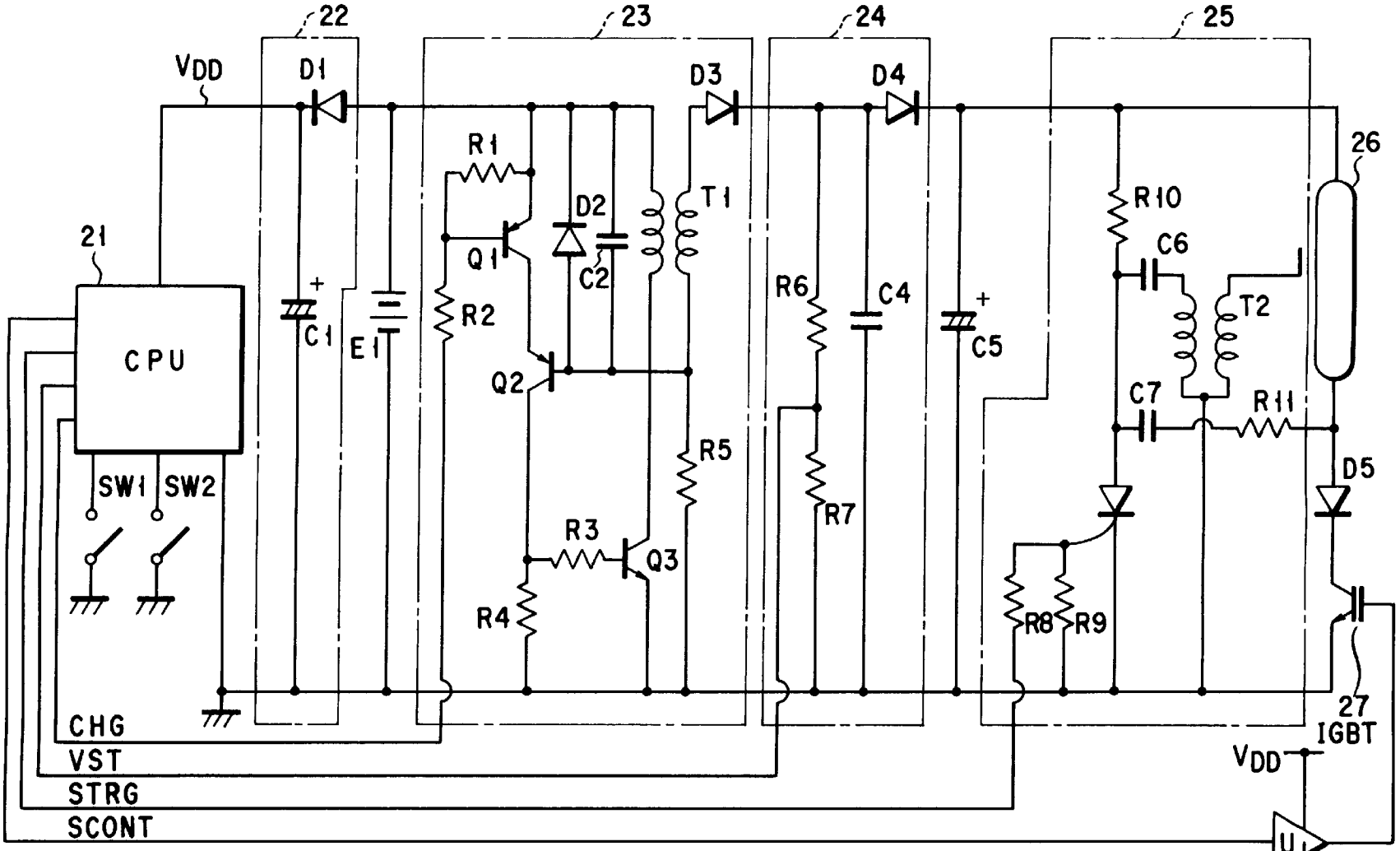
FIG. 6 is a diagram showing a stroboscopic device according to another embodiment of the present invention.

FIG. 6 is a diagram showing a stroboscopic device according to another embodiment of the present invention. In FIG. 6, the same elements as shown in FIG. 2 are identified with the same reference numerals as used in FIG. 2, and descriptions thereof are omitted.

The structure shown in FIG. 6 is different from that shown in FIG. 2 in that a voltage is applied to the gate of the IGBT 27 through a buffer V1. With this structure, since the voltage is thus applied through the buffer, a gate drive current supplied to the IGBT 27 is increased, so that the IGBT 27 can be turned on or off at high speed.

An operation of this embodiment will be described with reference to the timing charts shown in FIG. 7A to 7G. FIG. 7G is an enlarged view of a portion t2 of the signal SCONT shown in FIG. 7D.

When the signal CHG is caused to be low in level, the booster power circuit 23 in the stroboscopic circuit is operated and a boosted voltage is charged in the main capacitor C5. The charged voltage is monitored by the voltage detecting circuit 24. When the monitored voltage reaches a predetermined value, the signal CHG is caused to be high in level and the boosting operation is ceased. In a light emitting operation, when the signal SCONT and the signal STRG are caused to be high in level in response to a light emission start signal, the IGBT 27 is turned on, and at the same time, the flash discharge tube 26 is excited by the trigger circuit 25 and starts emitting.

The signal SCONT is output as a series of pulses of high and low levels in very short period. The IGBT 27 is repeatedly turned on and off in synchronism with the pulses. Once the flash discharge tube 26 is excited, even if the discharge tube is not triggered by the trigger circuit 25, short flash can be repeated by the on/off operation of the IGBT 27, so that substantially flat light emission can be realized. In a camera with a focal-plane shutter using flat light emission, the stroboscopic device can be used even in slit exposure time, so that high speed stroboscopic synchronization can be realized. The stroboscopic circuits shown in FIGS. 2 and 6 can perform a pre-emitting operation to reduce a pink-eye effect.

The pre-emitting operation for reducing a pink-eye effect will be described with reference to the timing charts of FIGS. 8A to 8F. When the signal CHG is low in level (see FIG. 8A), the booster power circuit 23 is operated and a boosted voltage is charged in the main capacitor C5 (see FIG. 8B). The charged voltage is monitored by the voltage detecting circuit 24. When the monitored voltage reaches a predetermined value, the signal CHG is caused to be high in level (FIG. 8A) and the boosting operation is ceased.

In a light emitting operation, the signals STRG and SCONT are caused to be high in level in response to a light emission start signal (see FIGS. 8D and 8E), the flash discharge tube 26 is excited by the trigger circuit 25 and starts emitting (see FIG. 8F). When the signal SCONT is caused to be low in level after a period of tw, the light emission is ceased (see FIGS. 8D to 8F). Short emission corresponding to the period tw is repeated for about 1 second at intervals of tens of microseconds (see FIG. 8F), main light emission for photographing is performed.

Hereinabove, normal flash light emitting, flat light emitting, and pink-eye effect preventing pre-emitting for operations have been described. Power-saving light emission, which is an object of the present invention, will now be described in detail, taking the flash light emitting operation as an example. Since the same circuit configuration as those shown in FIGS. 2 and 6 is used in the power-saving light emission, the description of the circuit is omitted.

Figure 9:
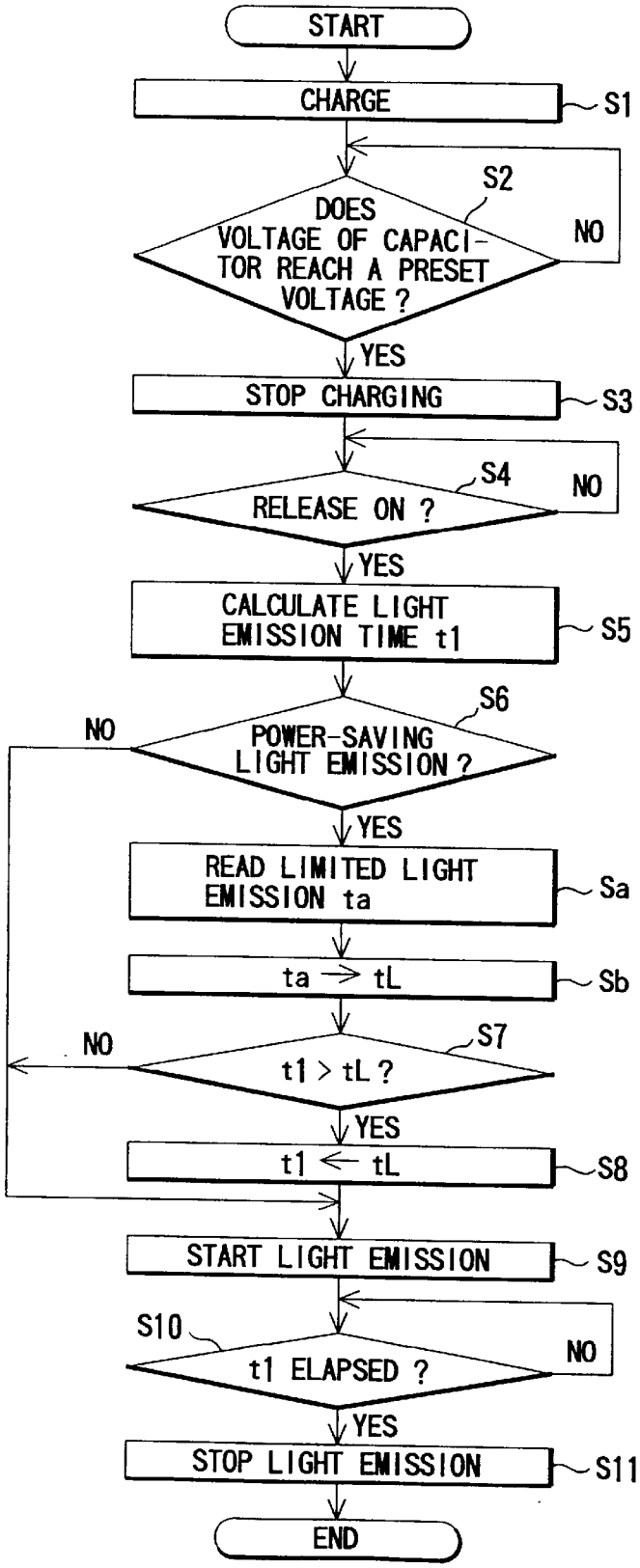
FIG. 9 is a flowchart of a power-saving operation of the stroboscopic device.

A power-saving light emitting operation will now be described with reference to the flowchart shown in FIG. 9. The CPU 21 starts an operation of charging the main capacitor of the stroboscopic device (Step S1), and then determines whether the voltage of the main capacitor reaches a preset voltage (Step S2). When the voltage of the main capacitor reaches the preset voltage, the CPU stops the charging operation (Step S3). Subsequently, the CPU 21 determines whether a release switch (not shown) is depressed (Step S4). If the release switch is depressed, the flow advances to Step S5.

In Step S5, the CPU 21 calculates a period of light emission time of the stroboscopic device. The period light emission time t1 is determined by GNo, which is determined by the stop value of the camera and the distance to the object. The period of light emission timek t1 is obtained by a functional calculus or a table reference. Then, the CPU determines whether the power-saving light emission or the normal light emission is set (Step S6).

If it is determined that the power-saving light emission mode is set in Step S6, a period of limited light emission time ta stored in an EEPROM or a memory (not shown) in the CPU is read out (Step Sa), and the value of ta is set to tL (Step Sb). The power-saving light emission can be set either by setting the device to a power-saving light emission mode or automatically setting the power-saving light emission in accordance with a photographing mode of the camera. Subsequently the CPU 21 compares the period of light emission time t1 calculated in Step S5 with the period of limited light emission time tL (Step S7).

Prior to describing the subsequent steps, the period of limited light emission time tL will be described with reference to the timing charts shown in FIGS. 10 and 11.

FIGS. 10A to 10D show a case of the normal light emission. A period of time tWP, between the timing when the signal STRG becomes high in level and the timing when the signal SCONT becomes low in level, is a period of full light emission time. In this period of time, if the initial voltage of the main capacitor is 300V, it is dropped to about 50V. The waveform of the light emission at this time is shown in FIG. 1D.

FIGS. 11A to 11D show a case of the power-saving light emission. A light emission time tL is set shorter than tWP. The residual capacity of the capacitor and the light emission time may be preset or set later to desirable values. If the light emission time is tL at maximum, the voltage VMC of the main capacitor is lowered only to 100V, when light is emitted for a period of time tL. Thus, since a voltage of 100V remains in the main capacitor, a next charge can start from 100V. In general, the boosting efficiency of the booster circuit in a stroboscopic circuit at a voltage lower than 100V is very low. According to the present invention, since it is unnecessary to perform inefficient charge under 100V, the efficiency of the boosting operation can be increased. For example, in a stroboscopic device for boosting a main capacitor of the capacity of about 300V to about 300V, the charge efficiency can be 10% to 20% improved in the power-saving light emission case as compared to the other case, and the lifetime of the battery of the camera is increased accordingly.

In the case of power-saving light emission, one may be anxious about a decrease of the amount of light in full light emission owing to the residual voltage of 100V. However, since the energy stored in the main capacitor is proportional to the square of the voltage, the difference in energy between the case of using the voltage lower than 100V and the other case is very little. For example, in stroboscopic photography in an amount light of about GNo15, the reduction of the amount of light in full light emission is only 0.06BV, which does not influence the general photography at all.

Referring back to FIG. 9, when tl is greater than tL in Step S7, t1 is limited to tL (Step S8), and then light emission is started (Step S9). Subsequently, it is determined whether the period of time t1 has elapsed (Step S10). If the time t1 has elapsed, the light emission is stopped (Step S11).

The present invention is not limited to the above embodiment, but various modification and improvement can be made without departing from the scope of the invention. For example, although the residual voltage is set to 100V in the above embodiment, if it is set to a higher voltage, further power-saving can be achieved. Moreover, in the above embodiments, the limited period of light emission time tL is constant; however, it is preferable that the time tL be changed in accordance with the voltage of the main capacitor before light emission.

Figure 12:
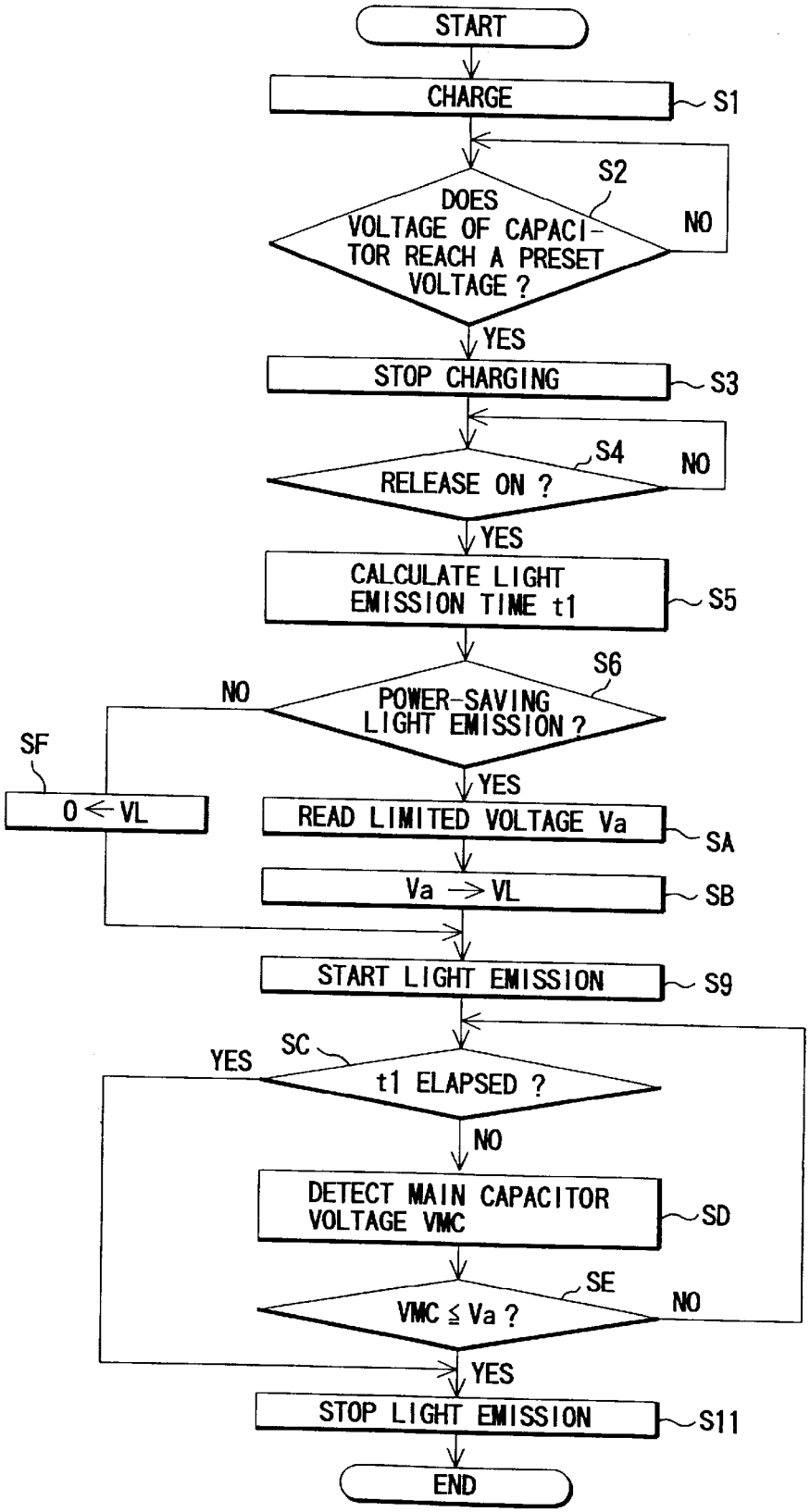
FIG. 12 is a flow chart showing a modification of the sequence shown in FIG. 9.

An improvement of the sequence shown in FIG. 9 will now be described with reference to the flowchart shown in FIG. 12. Since the processes in Steps 1 to 6 of FIG. 12 are the same as those of FIG. 9, the description thereof is omitted.

If it is determined that the device is set to the power-saving light emission mode in Step S6, a limited voltage Va stored in an EEPROM (not shown) or a memory in the CPU is read out (Step SA), and the value of Va is set to VL (Step SB). If it is not determined that the device is set to the power-saving light emission mode in Step S6, VL is set to 0.

Then, light emission is started (Step S9). Subsequently, it is determined whether the period of time t1 has elapsed (Step SC). If not, the voltage VMC in the main capacitor is detected (Step SD). If it is determined that VMC is equal to or lower than Va (Step SE), the light emission is stopped (Step S11).

In Step SE, if it is determined that VMC is not equal to or lower than Va, the process returns to Step SC and the light emission is continued. In Step SC, if it is determined that the time t1 has elapsed, the light emission is stopped. And in the case of the device not being set to the power-saving light emission mode, since VL is set to 0, the light emission is stopped by the lapse of the time t1, irrespective of the main capacitor voltage.

As has been described above, the present invention provides a power-saving stroboscopic device, in which the main capacitor is not completely discharged even in full light emission, so that a predetermined amount of charge can be left.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A stroboscopic device for illuminating an object, comprising:

a discharge tube for emitting light to illuminate the object;

a capacitor for storing energy to cause the discharge tube to emit light;

a charging circuit for charging the capacitor;

residual energy lower limit setting means for setting a lower limit of residual energy in the capacitor after the discharge tube has emitted light;

determining means for determining whether the lower limit of residual energy in the capacitor is set; and light emission control means for, if the determining means determines that the lower limit of residual energy is set, discharging the energy from the capacitor through the discharge tube, thereby causing the discharge tube to emit light, and for controlling light emission so that the capacitor retains residual energy greater than the lower limit after discharge.

2. The stroboscopic device according to claim 1, wherein the light emission control means controls a period of light emission of the discharge tube, thereby controlling the residual energy to a predetermined value.

3. A stroboscopic device for illuminating an object, comprising:

a discharge tube for emitting light to illuminate the object;

a capacitor for storing energy to cause the discharge tube to emit light;

a charging circuit for charging the capacitor;

a light emitting circuit for causing the discharge tube to emit light by discharging the energy from the capacitor through the discharge tube;

selecting means for selecting one of a normal light emission mode and an energy-saving light emission mode in which a maximum amount of emitted light is less than that in full light emission in the normal light emission mode; and a light emission control circuit for controlling an amount of light emission in the mode selected by the selecting means.

4. The stroboscopic device according to claim 3, wherein the light emission control circuit controls the maximum amount of emitted light in the energy-saving light emission mode by controlling a period of light emission according to a residual energy of the capacitor defined in the energy-saving light emission mode.

5. The stroboscopic device according to claim 3, wherein the light emission control circuit controls the maximum amount of emitted light in the energy-saving light emission mode by controlling a period of light emission of the discharge tube.

6. A stroboscopic device for illuminating an object, comprising:

a discharge tube for emitting light to illuminate the object;

a capacitor for storing energy to cause the discharge tube to emit light;

a charging circuit for charging the capacitor;

a light emitting circuit for causing the discharge tube to emit light by discharging the energy from the capacitor through the discharge tube;

time counting means for counting time from a start of light emission;

light emission continuation time setting means for setting a period of light emission during which light emission continues from the start of light emission to an end of light emission; and a control circuit for controlling the light emitting circuit to cause the discharge tube to emit light by discharging the energy from the capacitor through the discharge tube in a manner such that an actual period of light emission does not exceed the period of light emission set by the light emission continuation time setting means.

7. A stroboscopic device for illuminating an object, comprising:

a discharge tube for emitting light to illuminate the object;

a capacitor for storing energy to cause the discharge tube to emit light;

a charging circuit for charging the capacitor;

a light emitting circuit for causing the discharge tube to emit light by discharging the energy of the capacitor through the discharge tube;

time counting means for counting time from a start of light emission;

light emission continuation time setting means for setting a period of light emission during which light emission continues from the start of light emission to an end of light emission;

determining means for determining whether the period of light emission is set; and control means for, if the determining means determines that the period of light emission is set, controlling light emission such that an actual period of light emission does not exceed the set period.

8. A power-saving stroboscopic device for illuminating an object, comprising:

a discharge tube for emitting light to illuminate the object;

a capacitor for storing energy to cause the discharge tube to emit light;

a charging circuit for charging the capacitor;

voltage detecting means for detecting a voltage of the capacitor;

a light emitting circuit for causing the discharge tube to emit light by discharging the energy of the capacitor through the discharge tube; and a light emission stopping circuit for stopping light emission when the voltage of the capacitor detected by the voltage detecting means is at a predetermined value.

9. A power-saving stroboscopic device comprising:

a light emission discharge tube which emits light by discharging a main capacitor;

light emission time setting means for setting a period of light emission such that a residual voltage in the main capacitor after light emission is higher than a residual voltage after normal full light emission; and light emission control means for controlling light emission of the light emission discharge tube in accordance with the set period of light emission.

10. A power-saving stroboscopic device comprising:

a light emission discharge tube which emits light by discharging a main capacitor;

light emission time setting means for setting a period of light emission such that a residual voltage in the main capacitor after light emission is higher than a residual voltage after normal full light emission;

light emission time changing means for changing the set period of light emission in accordance with a voltage of the main capacitor before light emission; and light emission control means for controlling light emission of the light emission discharge tube in accordance with the changed period of light emission.

11. A power-saving stroboscopic device comprising:

a light emission discharge tube which emits light by discharging a main capacitor;

selecting means for selecting one of a normal light emission mode for performing full light emission and an energy-saving light emission mode in which consumed light emission energy is suppressed to a level lower than that in the full light emission; and light emission control means for setting a period of light emission such that when the energy-saving light emission mode is selected, a residual voltage in the main capacitor after light emission is higher than a residual voltage after full light emission, and for controlling light emission of the light emission discharge tube in accordance with the set period of light emission.

12. A power-saving stroboscopic device comprising:

a light emission discharge tube which emits light by discharging a main capacitor;

selecting means for selecting one of a first period of light emission calculated in accordance with a scene to be photographed and a second period of light emission such that a residual voltage in the main capacitor after light emission is higher than a residual voltage after full light emission, said selecting means selecting the second period of light emission if the second period of light emission is shorter than the first period of light emission, and said selecting means selecting the first period of light emission if the second period of light emission is not shorter than the first period of light emission; and light emission control means for controlling light emission of the light emission discharge tube in accordance with the selected period of light emission.

13. A power-saving stroboscopic device comprising a voltage control circuit for controlling a residual voltage in a main capacitor such that the residual voltage in the main capacitor after light emission is higher than a residual voltage after full light emission, in order to improve a charge efficiency of the main capacitor after the full light emission.

14. A stroboscopic device according to claim 13, wherein the voltage control means controls the residual voltage in the main capacitor based on a period of light emission of the stroboscopic device.

15. A stroboscopic device according to claim 14, wherein the voltage control means controls the period of light emission in accordance with a voltage in the main capacitor before light emission.

16. A power-saving stroboscopic device, comprising:

calculating means for calculating a period of light emission set by predetermined photographic conditions;

comparing means for comparing a first period of light emission with a second period of light emission in which a residual voltage in the main capacitor after light emission is higher than a residual voltage after full light emission; and stroboscopic control means for controlling the first and second periods of light emission based on the calculated period of light emission.

17. A power-saving stroboscopic device, comprising:

selecting means for selecting one of a normal light emission mode in which full light emission is performed and an energy-saving light emission mode in which light emission is ceased slightly earlier than during full light emission in the normal light emission mode; and light emission control means for controlling a period of light emission such that a residual voltage in a main capacitor after light emission is higher than a residual voltage after full light emission, when the energy-saving light emission mode is selected.

18. A stroboscopic device according to claim 17, wherein the light emitter control means controls the residual voltage in the main capacitor based on a period of light emission of the stroboscopic device.

19. A stroboscopic device according to claim 17, wherein the light emission control means controls the period of light emission in accordance with a voltage in the main capacitor before light emission.

20. A power-saving stroboscopic device, comprising:

selecting means for selecting one of a normal light emission mode in which full light emission is performed and an energy-saving light emission mode in which light emission is ceased slightly earlier than during full light emission in the normal light emission mode;

determining means for determining whether a period of light emission set in accordance with a distance to an object is within a limited period of light emission which is predetermined for the energy-saving light emission mode, when the energy-saving light emission mode is selected; and light emission control means for controlling an actual period of light emission such that a residual voltage in a main capacitor after light emission is higher than a residual voltage after full light emission, when the set period of light emission is not within the limited period of light emission.

21. A Power-saving stroboscopic device, comprising:

calculating means for calculating a period of light emission set by predetermined photographic conditions;

selecting means for selecting one of a normal light emission mode in which full light emission is performed and an energy-saving light emission mode in which light emission is ceased slightly earlier than during full light emission in the normal light emission mode;

determining means for determining whether the calculated period of light emission is within a limited period of light emission which is predetermined for the energy-saving light emission mode, when the energy-saving light emission mode is selected; and stroboscopic control means for controlling emission of emitting stroboscopic light based on the calculated period of light emission, when the calculated period of light emission is shorter than the limited period of light emission.

* * * * *